US011344087B2

(12) United States Patent
Baca

(10) Patent No.: US 11,344,087 B2
(45) Date of Patent: May 31, 2022

(54) MAGNETIC LOCK AND RELEASE CLASP SYSTEM

(71) Applicant: Angela Yvonne Baca, Albuquerque, NM (US)

(72) Inventor: Angela Yvonne Baca, Albuquerque, NM (US)

( * ) Notice: Subject to any disclaimer, the term of this patent is extended or adjusted under 35 U.S.C. 154(b) by 89 days.

(21) Appl. No.: 16/936,147

(22) Filed: Jul. 22, 2020

(65) Prior Publication Data

US 2022/0022610 A1 Jan. 27, 2022

(51) Int. Cl.
*A44C 5/20* (2006.01)

(52) U.S. Cl.
CPC ..... *A44C 5/2009* (2013.01); *A44D 2203/00* (2013.01)

(58) Field of Classification Search
CPC .. A44C 5/2009; A44C 5/2014; A44D 2203/00
See application file for complete search history.

(56) References Cited

U.S. PATENT DOCUMENTS 267,112 A * 11/1882 Sanderson ..... A44B 15/00 24/598.2
5,349,725 A * 9/1994 Levy ..... A44C 5/2009 24/303
7,013,674 B2 * 3/2006 Kretchmer ..... A44C 5/0092 446/137
7,104,948 B2 * 9/2006 Kaizuka ..... A61N 5/06 600/15
7,216,508 B2 * 5/2007 Kretchmer ..... A44C 5/0092 63/3
7,726,152 B2 * 6/2010 Beard ..... A44C 5/2076 63/3.1
9,775,413 B1 * 10/2017 Ingimundarson ..... A45D 8/00
2011/0047759 A1 * 3/2011 Reiter ..... A44B 17/0041 24/303
2015/0173468 A1 * 6/2015 Stevenson ..... H01F 7/0221 63/12
2016/0120273 A1 * 5/2016 Lee ..... A44C 7/007 63/14.1

* cited by examiner

*Primary Examiner* — Robert Sandy
*Assistant Examiner* — Louis A Mercado

(57) ABSTRACT

A clasp and connection to an opposing ring. Although applicable to any clasp system, it is especially relevant to jewelry connections in necklaces or bracelets whereby the connecting rings are quite small requiring visual acuity and manual dexterity to operate. The user pulls back the plunger within the clasp ring and sets it in a locked and open position allowing the user to gain manual dexterity for guiding the clasp towards the opposing ring. A feature in which a magnetic portion of the clasp and opposing ring allows the two rings to be guided towards each other and position them for connection and further ensure tight closure. Since visual acuity is not always possible, this magnetic guide is critical.

2 Claims, 3 Drawing Sheets

MAGNETIC LOCK AND RELEASE CLASP SYSTEM

CROSS REFERENCE TO RELATED APPLICATIONS

This patent is related to Spring Ring Patent No 267,112, Nov. 7, 1882

STATEMENT REGARDING FEDERALLY SPONSORED RESEARCH OR DEVELOPMENT (Not Applicable)

REFERENCE TO SEQUENCE LISTING, A TABLE, OR A COMPUTER PROGRAM LISTING COMPACT DISK APPENDIX (Not Applicable)

BACKGROUND OF THE INVENTION

This invention pertains to a clasp design that can be used for jewelry or chain closures, primarily related to a necklace or bracelet but also applicable to a chain or bike lock type system. The clasp generally has an attachment loop so that it can be attached to necklaces, chains, etc. with a spring loaded plunger within a bore of a curved body such as a circle or oval.

Related Patent Classifications: CPC Definition A44B Buttons, pins, buckles, slide fasteners, or the like (fastenings) US Class 24 series; Class 413 Joints and Connections; Class D11 Jewelry, Symbolic Insignia, and Ornaments The prior art related to this invention is associated with the Spring Ring Patent No 267,112, Nov. 7, 1882. The Spring Ring design used a plunger that would slide within a bore of a ring. It could be retracted with spring resistance and would close from the compressive force of the spring inside the ring and requires the operator to maintain pressure on the spring at all times in order to remain open. The new invention described here uses this prior art but adds three new claims associated with controlling and locking the plunger so the user can gain dexterity and guiding the opposing ring to the clasp ring to aid the user in connecting the two rings.

With current connections related to jewelry, there is great difficulty adjoining two pieces of small metal circles to make a secure linkage due to dexterity issues as well as visual limitations due to the small size of adjoining ends and their openings. This can become further complicated when working under difficult circumstances such as when you cannot visibly observe the connection process (i.e., necklace). Also, with current connections, you typically need your thumb and forefinger to hold latch open, which further limits the dexterity (additional fingers or hands), available to manipulate the latching process. In some cases, your hand may slip when holding latch open before connection is made, further frustrating the operator.

BRIEF SUMMARY OF THE INVENTION

This invention utilizes a magnetized clasp with a built in lock and release system that would allow you to secure two connecting ends of a chain or rope to make a circular connection, with the guided assistance of a magnetic field. The magnetic field also serves as an extra means to further ensure a strong connection when the clasp is closed to ensure the connection isn't compromised and jewelry is lost. The lock and release feature of the clasp allow for the clasp portion to remain open while attempting to connect two rings. The imbedded magnet helps guide the user to easily locate the opening of the clasp. For example, these two pieces can be connected to either end of a necklace, bracelet, cables or a bike chain. This invention would be especially beneficial for use with jewelry or delicate, small systems which make it difficult to connect the clasp or find the opening in order to insert the other circle in to make a connection. It aids the challenge of spending several minutes and frustration trying to attach two ends when you can't see (such as attaching a necklace with a small opening behind your head). It also aids when there is a lack dexterity or visual acuity, as when fastening a bracelet on once hand with the other hand, or when the opening of the open-ended circle closes when your finger slips off of the lever.

DETAILED DESCRIPTION OF THE INVENTION

Illustrated embodiments of this invention can be used to open a section of a circular clasp and allow it to remain/lock in the open position. Pushing on the button or knob allows the retracted circle or plunger to close, making a secure connection. The magnetic section on the clasp guides the ferromagnetic opposing ring to the opening to connect the two rings. The magnetic section also makes a more secure closure when the clasp is closed. Both of these invention embodiments improve upon limitations in the previous Spring Ring Patent No 267,112 which only focused on the coil spring and plunger in association with opening and closing the clasp.

Figure 1:
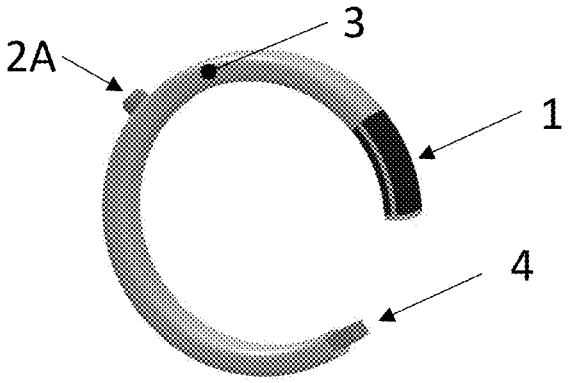
FIG. 1 diagrammatically illustrated Magnetic Lock and Release Clasp in the open position according to the illustrated embodiments of the invention.

The illustrated embodiments of the invention use components to lock the clasp in the open position as well as guide the opposing ring to mate with the clasp. FIG. 1 diagram illustrates the exemplary embodiments of the Magnetic Lock and Release Clasp in isolation and in the open position. FIG. 1 will be used to identify and refer to the Magnetic Lock and Release System. It is comprised of a hollow metal circle with a knob 2 attached to a plunger 4, coil spring 3 and magnetized segment. The knob and plunger work as part of a lock and release system and additional components which will be described in further detail. This system allows the plunger 4 to be pulled back (retracted inside arc-shaped bore) and locked in open position 2A to create an opening. This system also allows the plunger to be released in order to make a secure closure/circle. This system herein will be referred to as the lock and release system. The circle of the Magnetic Lock and Release Clasp has a segment that is hollow (to accommodate the plunger and spring) and a segment that is solid where a magnetized segment 1, is located. The magnetized segment 1 is located at the end of opposite side of retracted metal piece when it is in the open position. This magnetic segment serves as a guide for the user to locate the opening to the clasp. The remainder of the hollow circle can be comprised of any metallic compound such as steel, silver, gold or platinum.

Figure 3:
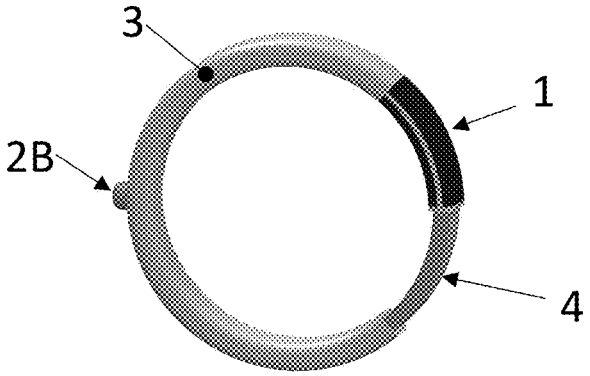
FIG. 3 diagrammatically illustrates Magnetic Lock and Release Clasp in closed position according to exemplary embodiments of the invention.
Figure 5:
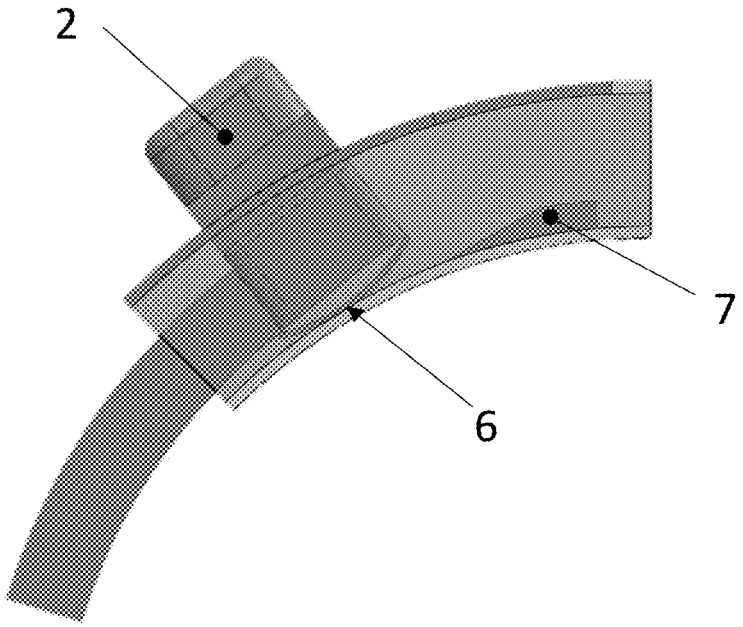
FIG. 5 diagrammatically illustrates the components of the lock and release system in more detail according to further illustrate embodiments of this invention.

FIGS. 1, 3 and 5 illustrate exemplary exterior embodiments of the lock and release system that are incorporated into the clasp to allow lock and release functioning. The lock and release system is comprised of a button or knob 2, herein referred to as the knob. When referred to in general, the knob will be referred to as 2 however, the knob can be positioned in two different positions—open 2A and closed 2B. The knob is attached to the retracted metal bar/plunger 4, herein referred to as the plunger. The system works in conjunction with the coil spring 3, which is not pictured (spring is currently being used in association with patent no. 267,122 and is not new to invention). The lock and release system is used to retract and lock the plunger 4 into the open position when pulled back by the operator, pulling it into the open position 2A. The coil spring, 3 (not pictured), is positioned between the knob/plunger and the magnetized segment 1. (illustrated in FIG. 1). The region where the magnetized segment 1 is located is solid in order to both provide the appropriate magnetic field and allow for a stop or place of resistance for the coiled spring to react against.

FIG. 5 illustrates the interior components of the lock and release system in greater detail. The button/knob 2, which is attached to the end of the retracted plunger 4, has a pliable leaf spring 6 built into the underside. There is also an interior ramp 7 within the bore, which is a solid, non-deforming metal built into the interior of the circular ring just below the position where the button locks into place. The pliable leaf spring 6 and ramp 7 work in conjunction to allow the button/knob 2 to be guided and pushed up into the locked open position 2A and to close the clasp into the closed position 2B.

FIG. 1 illustrates the embodiments of the clasp and position of the knob, 2. When the knob 2 is pulled back by the operator into the open position 2A, the part of the clasp which is the metal bar/plunger 4 retracts inside the hollow circle or bore, to create an opening that is locked open allowing the user time to connect the opposing ring and freeing the fingers of the hand holding the clasp, in order to further improve dexterity.

Figure 6:
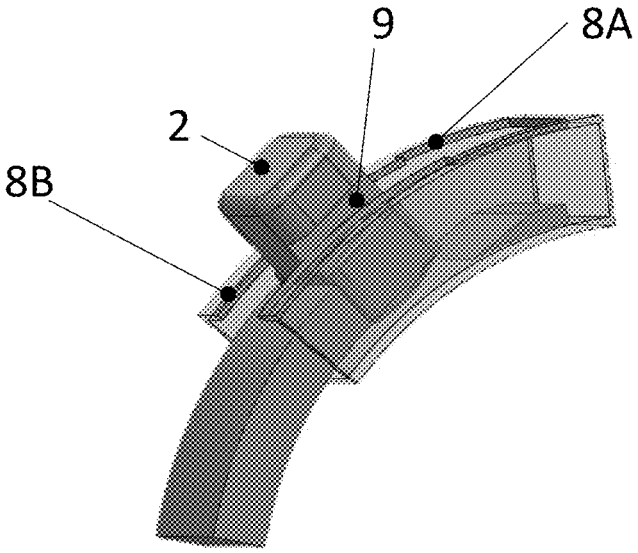
FIG. 6 perspective diagram illustration of the interior and exterior design of the FIG. 1 Magnetic Lock and Release Clasp that encompasses the lock and release system in more detail according to further exemplary embodiments of the invention.
Figure 7:
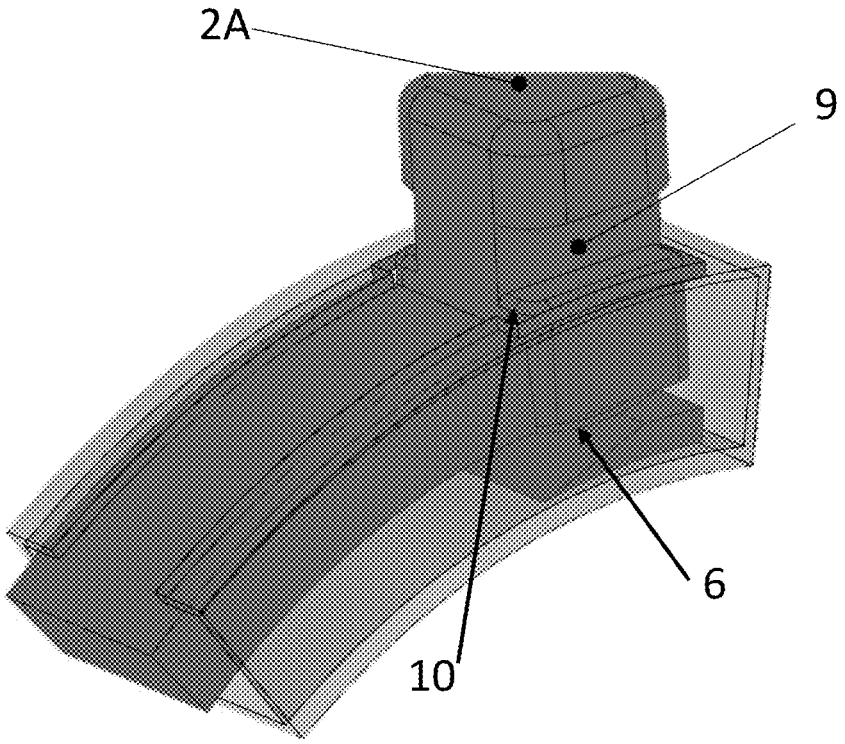
FIG. 7 diagrammatically illustrates a top perspective sectional view of FIG. 1 exterior and interior components of lock and release mechanism in more detail according to the illustrated embodiments of the invention.

FIG. 6 diagrammatically illustrates in greater detail the design of the clasp which allows the lock and release system to function. The design of the exterior composition of circular tube has a segment with a groove cutout, 8B and 8A. 8B is a narrow groove that is long enough to allow the plunger to retract completely inside the bore of the circle. 8A is a wider groove cutout that is at the stopping point. 8A is also shaped to fit the shape designed at the bottom of a knob base 10 (FIG. 7). The knob 2 slides within the narrow-shaped rail, or the narrow cutout groove 8B, which is designed to fit the size of a notched segment 9, in the knob. The embodiments of this invention allow the notched section 9 to slide within the narrow cutout groove 8B until it locks into the wider cutout groove 8A by means of the wider base of a knob base 10 being pushed upward by the spring/ramp portion of the design. This is the open position 2A.

FIGS. 6 and 7 illustrate in greater detail the embodiments of the knob that are specific to the lock and release system. The knob is designed with three distinct segments. The top segment (which is not new to the invention), the notched segment 9 and the knob base 10. The notched segment 9 is a notched segment. This design allows this notched and narrower segment of the notched segment 9 to slide through a narrow groove 8B. The knob base 10 is wider, which encases it in the bore along the narrow cutout groove 8B. The shape of the knob base 10 is wider and designed to fit into the wider cutout groove 8A, which locks it in place. The shape of the top segment of the knob 2 can be wider than the notched segment 9 in order to further emphasize notched segment 9 but may not necessary to the function.

FIGS. 5, 6 and 7 illustrate an interior view of the clasp in order to show all the exemplary embodiments of the lock and release system which work together to guide the mechanism to lock in place when the clasp is open and conversely allow it to close. The knob base 10 has a pliable leaf spring, 6, on the underside of the base. The knob base 10 is designed to be wider at the bottom. The bottom segment of a knob base 10 slides in the bore of the clasp when the operator pulls the knob back toward the open position, 2A. The notched segment 9 allows the knob to slide through the narrow cutout groove 8B. An interior ramp 7, which is a solid, non-deforming metal ramp, is built into the bore of the clasp, just below the position where the knob locks into the wider cutout groove 8A. The ramp, 7, is positioned as illustrated in FIGS. 6 and 7, directly below the wider cutout groove 8A. This positioning allows the button/knob 2 to slide up the ramp when the operator pulls the knob 2 back with the use of a thumb or forefinger toward the open position 2A, locked open position. As the operator pulls the knob back, the knob 2 slides through narrow groove 8B until it reaches ramp 7. When pulled over ramp 7, the knob base 10 and leaf spring 6 slide up ramp 7 pushing the knob up to expose wider bottom section of the knob base 10 into the wider cutout groove 8A. Once the knob base 10 is in the wider cutout grove 8A, the knob and plunger are locked into the open position 2A. The knob is secured in place because the narrow cutout groove 8B and the placement of the ramp 7 do not allow the base of the knob base 10 to slide back into closed position 2B. The ramp 7 and its placement within the bore pushes the knob up so the knob base 10 remains in place, with the plunger retracted, until released by the operator.

The following paragraphs describe the operation process of the system, by the operator, with references to the specific design embodiments.

To retract and open the clasp, the user pulls the knob back and the lock and release system pushes against the coil spring 3 from FIG. 1, whereby the spring 3 is compressed. FIG. 6 illustrates the design of the wider cutout groove 8A and the design of the lock and release system components which allows the knob 2 to glide into the wider cutout groove 8A. FIG. 7 illustrates the positioning of the open position 2A in the locked open position. Once in the open position 2A the clasp remains in a locked position with the plunger retracted inside the bore. While in locked, open position 2A the spring 3 is pushed back and remains in a compression position.

FIG. 7 diagrammatically illustrates the knob in the open position 2A, which is open and locked position. Once locked into place, an opening in the clasp is created and maintained without the operator having to hold it open with their fingers. The purpose of locking into place during this step allows for freeing the fingers of that hand to provide increased dexterity and ample time for guiding the opposing ferromagnetic ring 5 from FIG. 2 within the clasp.

Figure 2:
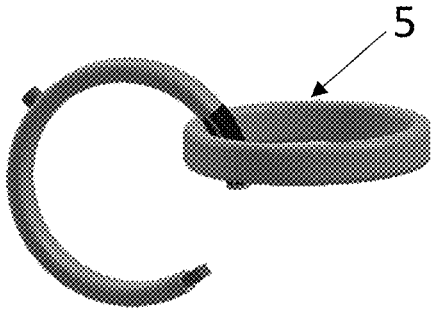
FIG. 2 illustrates a perspective view of the Magnetic Lock and Release Clasp and opposing ferromagnetic ring according to the embodiments of the invention.

FIG. 2 illustrates how the magnetized segment 1 is used to draw or guide the opposing circular or oval ring 5, which is comprised of a ferromagnetic material, to easily find the interior of the circle opening, connecting the two ends. The purpose of the magnetized segment 1 is to assist operator in difficult circumstances such as when putting on a necklace behind one's head whereby the process is not visible to the user.

Figure 4:
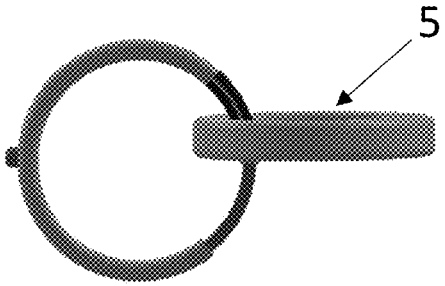
FIG. 4 illustrates a perspective view of the Magnetic Lock and Release Clasp shown in the closed position with the ferromagnetic opposing ring locked inside the circle.

FIG. 4 Diagram illustrates how the Magnetic Lock and Release Clasp, FIG. 1, is used to secure the other opposing ring 5, which can be circular or oval in shape, making a connection. This connection can be used in order to connect two ends of a necklace, bracelet, bike chain or any other entity that requires locking two adjoining ends. The clasp generally has an attachment loop so that it can be attached to necklaces, chains, etc.

FIGS. 3, 5, 6 and 7 illustrate how the lock and release system design allows the user to also release and close the clasp. User pushes the button/knob when in the open position 2A down, which will cause the leaf spring, 6, to compress against ramp 7. This allows the base of the knob base 10 to recede into the bore and expose the grooved section, 9, of the knob 2. This allows the knob 2, which is attached to plunger 4 from FIG. 1 to slide back downward from 8A into the narrow cutout groove 8B of the clasp moving toward closed position 2B. The spring 3 releases and knob and plunger glide along the narrow cutout groove 8B and plunger, 4, from FIG. 3 and is pushed out of the bore into a closed position 2B by the force of the released coil spring 3 from FIG. 3. This will allow the clasp to close tightly to closed position 2B, to make a secure closure. The plunger 4 may also be composed of ferromagnetic material to further ensure a tight closure, in conjunction with the release of the spring 3.

FIG. 4 illustrates the intended use of the invention with the clasp in a closed position 2B. After mating the ferromagnetic ring, 5, the plunger is fully released and exposed with the pressure of the released spring 3, making a secure closure against the magnetized segment.

What is claimed is:

1. A circular clasp comprises:

a clasp body including a groove provided along a portion of an exterior surface of the clasp body, the groove having a narrow groove portion in communication with a wider groove portion;

a plunger;

a spring inside the clasp body, which pushes the plunger to a closed position of the clasp;

a knob attached to the plunger and having a notched segment at a middle portion of the knob that works in conjunction with the groove, the knob including a base segment and a leaf spring provided on an underside of the base segment; and a ramp provided within and below the wider groove portion;

wherein when the knob is operated toward the wider groove portion to lock the plunger to an open position of the clasp, the leaf spring and the ramp push the knob to fit with the wider groove portion to lock the knob from movement; and wherein when the locked knob is pressed, the knob is released from the wider groove portion and the spring moves the plunger to the closed position of the clasp.

2. The circular clasp according to claim 1, wherein a section of the circular clasp is magnetized to guide a user in locating an opening so that an adjoining ring connector, which is composed of ferromagnetic material, can easily mate with the clasp and to further ensure tight closure with the plunger when in the closed position.

* * * * *